US005078185A

United States Patent [19]

Angarola

[11] Patent Number: 5,078,185

[45] Date of Patent: Jan. 7, 1992

[54] SEALER MECHANISM FOR A TOOL FOR APPLYING A SEAL TO OVERLAPPING LENGTHS OF STRAP

[75] Inventor: Barry R. Angarola, Schaumburg, Ill.

[73] Assignee: Signode Corporation, Glenview, Ill.

[21] Appl. No.: 639,205

[22] Filed: Jan. 9, 1991

[51] Int. Cl.[5] ..... B21F 9/02

[52] U.S. Cl. ..... 140/93.4; 140/150; 100/33 PB

[58] Field of Search ..... 140/93.4, 150, 151, 140/152; 100/30, 33, 33 PB

[56] References Cited

U.S. PATENT DOCUMENTS 2,315,596 4/1943 Childress ..... 140/152
3,021,876 2/1962 Hall et al. ..... 140/93.4
3,550,647 12/1970 Beach ..... 140/93.4

*Primary Examiner*—Lowell A. Larson
*Attorney, Agent, or Firm*—T. W. Buckman; D. J. Breh

[57] ABSTRACT

A method and apparatus are provided for applying a fold-over seal about overlapping lengths of strap. The open seal is positioned with the strap lengths between the legs. Opposing jaws are pivoted about axes against the open seal legs toward the strap lengths to bend the seal legs inwardly while decreasing the distance between the seal and the pivot axes of the jaws. The decrease in the distance between the jaw pivot axes and the seal is limited at a predetermined minimum distance, but the jaws continue to be pivoted to fold the seal legs adjacent the strap lengths. As the jaws approach the fully closed position, the distance between the seal and the jaw pivot axes is increased, and this forces the seal crown and legs closer together as the crimping of the seal is completed.

21 Claims, 4 Drawing Sheets

SEALER MECHANISM FOR A TOOL FOR APPLYING A SEAL TO OVERLAPPING LENGTHS OF STRAP

TECHNICAL FIELD

This invention relates to securement of the overlapping ends of a tensioned strap loop around a package or other object. More particularly, the present invention relates to an improved method and mechanism for crimping a seal around the overlapping lengths of strap to hold the strap lengths together.

BACKGROUND OF THE INVENTION AND TECHNICAL PROBLEMS POSED BY THE PRIOR ART

A variety of tools and machines have been proposed and/or are in use for tensioning a loop of strap around an article or articles, such as a stack of lumber, equipment on a pallet, and the like. Many kinds of such machines and tools also typically apply a metal seal to secure the overlapping strap lengths together and then sever a trailing portion of the strap length from a supply of the strap on a reel.

Typically, conventional strapping machines and tools of this type grip or hold a leading, free end segment of the strap with a suitable gripping device and then apply tension with a traction wheel which is rotated against the strap. After sufficiently high tension has been pulled on the strap, the tension is maintained on the strap while an open, generally U-shaped seal, which has been supplied from a magazine, is crimped about the overlapping strap portions to hold them together in tight engagement. At the termination of the crimping step, the trailing portion of the strap is severed by a suitable mechanism.

Conventional strapping tools of the type described above have been marketed in the U.S.A. by Signode Corporation, 3600 West Lake Avenue, Glenview, Ill. 60025. One such tool is marketed under the designation "SIGNODE Model ASD Combination Strapping Tool" and is disclosed in the "OPERATION AND PARTS MANUAL" for that tool as published by Signode Corporation under the document designation "REB 7/77-1M-A". Another such machine is marketed under the designation "SIGNODE AM COMBINATION STRAPPING TOOL" and is disclosed in the "OPERATION, PARTS AND SAFETY MANUAL" for that tool as published by Signode Corporation under the document designation "186027 (p. 20E) Rev. 10-89". Other tools of this general type have been marketed under the designation "SIGNODE ASL and ASM COMBINATION STRAPPING TOOLS" and are disclosed in the "OPERATION, PARTS AND SAFETY MANUAL" for such tools as published by Signode Corporation under the document designation "186101 (p. 69A) Rev. 2-90".

The above-identified tools are manually operated and typically include a housing, a tensioning assembly, a seal magazine assembly, a sealer assembly for applying the seal to the overlapping lengths of the strap after the strap has been tensioned, and a cutter mechanism for severing the sealed loop from the trailing portion of strap. Other tools performing the same functions may be pneumatically or electrically operated. Further, the functions may also be incorporated in large, automatic machines which also operate to initially feed the strap around the article to be bound and form a loop which is subsequently tensioned, sealed, and severed from the supply of strap.

The above-identified types of tools and machines typically employ a pair of pivoting jaws for crimping the seal about the overlapping lengths of strap. Typically, the strap and the seal are steel, and the jaws pivot to a closed position to deform the steel seal tightly about the overlapping strap lengths without effecting significant deleterious deformation of the steel strap per se.

Such a conventional jaw mechanism is usually employed in conjunction with a "chair" or anvil. The exterior surface of the crown of the seal is disposed adjacent the anvil with the seal open legs projecting downwardly on either side of the overlapping lengths of strap. The jaws pivot to the closed position and squeeze the seal legs inwardly and upwardly against the strap lengths while the anvil bears the reaction force. In some designs, the anvil is fixed relative to the jaw mechanism, and in other designs, the anvil is moved downwardly a small amount as the jaws close. In some cases, the anvil functions as, or is replaced by, a notching means to notch the edges of the seal and strap to provide increased holding strength.

While conventional sealing mechanisms have generally functioned well in the applications for which they were designed, there is a need for improved performance with respect to some applications to accommodate a variety of strap materials and thicknesses, different seal designs and materials, and different tension levels. An improved sealer mechanism or assembly would be especially desirable for use with metal seals applied to thermoplastic strap.

Conventional tools of the type described above have been used to apply metal seals to plastic strap, but the results, insofar as they are currently known to the present inventor, are not altogether satisfactory. In particular, when a metal seal is applied with conventional sealing mechanisms to overlapping thermoplastic strap, the legs of the seal do not bend and deform to the desired configuration that can be obtained when the same seal is crimped about metal strap.

Further, the thermoplastic strap becomes distorted, deformed, and tends to crack. The overall strength of the clamping effect of the seal is reduced, and the resulting configuration of the seal and strap lengths has protrusions which provide a potential for snagging.

FIG. 1 illustrates a metal seal S1 which has been applied with a conventional sealer mechanism (not illustrated) to overlapping lengths of thermoplastic strap—upper strap length U and lower strap length L. As best illustrated in FIG. 2, the seal S1 has a crown C1 and a pair of legs LG1. The legs LG1 are bent inwardly against the lower strap length L, but the legs LG1 are not parallel to the crown C1. Further, the legs LG1 have caused the upper strap length U and the lower strap length L to buckle downwardly so that there is a void region V1 between the upper strap length U and the seal crown C1 and so that there is another void region V2 between the upper strap length U and the lower strap length L.

It is apparent that there is relatively little surface contact between the seal crown cap C1 and the upper strap length U. Similarly, there is relatively little surface contact between the upper strap length U and the lower strap length L. The seal S1 and the strap lengths U and L are in surface-to-surface contact primarily only at the lateral edges. Thus, whatever joint strength is provided by the crimped seal configuration is provided in spite of this reduced surface-to-surface contact.

In addition, it has been found that the thermoplastic, lower strap length L sometimes tends to crack along the bulging region B where the lower strap length L bulges downwardly between the legs LG1. This cracking can further reduce the strength of the joint and lead to failure of the joint and/or strap under sufficiently high tension loads.

A desired sealed joint configuration for thermoplastic strap as well as metal strap is illustrated in FIG. 3 for a seal S2 having legs LG2 which have been crimped further upwardly so that they are substantially parallel to the strap length U and L and to the seal crown C2. This configuration is typically produced when a metal seal is properly crimped by conventional tools on a metal strap. The inside surface of the seal crown C2 is in surface-to-surface contact with the upper surface of the upper strap length U, the lower surface of the upper strap length U is in surface-to-surface contact with the lower strap length L, and the lower surface of the lower strap length L is in surface-to-surface contact with the seal legs LG2. The substantial surface contact provides increased frictional engagement and increases the strength of the sealed joint.

The strap lengths U and L remain generally flat and do not bulge outwardly. The generally flat configuration of the strap lengths U and L within the seal S2 reduces the potential for cracking and for increased stress concentration regions. Thus, it would be desirable to provide an improved sealer mechanism for producing a sealed joint having a preferred configuration as described above with reference to FIG. 3, and it would be desirable to provide such a sealer mechanism that could be employed to form such a sealed joint with a steel seal on thermoplastic strap as well as on metal strap.

It would also be beneficial to provide an improved sealer mechanism which would have the capability for being adjusted to accommodate a variety of seal designs and sizes as well as a variety of seal materials. Further, it would be desirable to provide such an improved sealer mechanism with the capability for being adjusted to accommodate a variety of strap thicknesses, widths, and materials.

SUMMARY OF THE INVENTION

The present invention provides a novel method for applying a fold-over seal about overlapping lengths of strap wherein the seal is initially furnished in an open condition with a pair of open legs joined by a central crown.

The seal is initially positioned with the strap lengths between the open seal legs. Jaws are pivoted about pivot axes against the open seal legs toward the strap lengths to bend the seal legs inwardly. As the jaws pivot toward the closed position, the seal is permitted to move under the influence of the jaws so that the distance between the seal and the pivot axes of the jaws is decreased. Movement of the seal toward the jaw pivot axes is limited at a selected point, and the jaws then continue to pivot to fold the seal legs adjacent the strap lengths. However, before the jaws are fully closed, the distance between the seal and the jaw pivot axes is increased to force the seal crown and the legs closer together and thereby complete the crimping of the seal about the strap lengths.

According to a preferred aspect of the method, an anvil is provided to engage the exterior of the seal crown and is permitted to move away from the strap lengths (or toward the jaw pivot axes) as the jaws pivot toward the closed position. However, the movement of the anvil is terminated before the jaws are fully closed, and eventually, the anvil is moved back toward the strap lengths to force the seal crown and legs closer together as the crimping of the seal is completed.

The novel method permits a change in the orientation of the forces applied to the seal legs by the jaws during the crimping process. The jaws are able to squeeze the seal legs more directly from the underside of the seal as the seal moves during an initial portion of the crimping process. The seal legs can be initially bent or wrapped about the overlapping strap lengths in a more desirable configuration since the bend region or folding radius of the seal is moved relative to the jaw pivot axes.

With this novel method, the strap per se need not function as a bending form or mandrel about which the seal legs are deformed. Rather, as the seal is moved and the location of the force applied to the seal legs by the jaws changes, the seal legs can be bent inwardly and upwardly in the desired configuration without the application of undesirably large forces to the strap lengths. This eliminates or substantially decreases the deformation of the overlapping strap lengths. The strap lengths are thus crimped in a desired configuration with greater frictional engagement forces.

In accordance with the teachings of the present invention, the above-described method can be effected with a novel sealing mechanism which includes a pair of opposing sealer jaws which are mounted for pivoting movement relative to an anvil against which the seal is forced by the jaws.

A first lost motion means is provided for mounting the anvil for reciprocative movement relative to the jaw pivot axes and for limiting the movement of the anvil seal-engaging surface relative to the jaw pivot axes—at least in the direction toward the jaw pivot axes.

A second lost motion means is provided for (1) accommodating the movement of the anvil seal-engaging surface toward the jaw pivot axes, and (2) effecting engagement between a portion of each jaw and the anvil at an end of the range of the second lost motion means as the jaws pivot toward the closed position whereby the anvil seal-engaging surface is driven by the jaws back away from the pivot axes toward the strap lengths.

In a preferred embodiment, the sealer assembly includes a biasing means for urging the anvil against the seal to normally maintain a maximum distance between the seal and the jaw pivot axes when the jaws are open. The jaw pivot axes are defined by two, parallel, pivot shafts. Each jaw is mounted on one of the shafts. One of the jaws is mounted to one of the shafts, and the other of the jaws is mounted to the other of the shafts. The anvil defines elongate apertures, and each aperture receives one of the shafts to permit relative movement between the shaft and an elongate aperture in a direction perpendicular to the length of the shaft. This arrangement of the shafts and apertures defines the first lost motion means.

The anvil has oppositely projecting tabs, and the jaws each define a driving surface for engaging one of the tabs. The anvil and jaws are arranged to prevent engagement between the tabs and driving surfaces when the jaws are in the open position. However, engagement is effected between the tabs and driving surfaces after the jaws have been pivoted from the open position through an initial portion of the total angular displacement. This arrangement defines the second lost motion means.

Numerous other advantages and features of the present invention will become readily apparent from the following detailed description of the invention, from the claims, and from the accompanying drawings.

BRIEF DESCRIPTION OF THE DRAWINGS

In the accompanying drawings forming part of the specification, in which like numerals are employed to designate like parts throughout the same.

DESCRIPTION OF THE PREFERRED EMBODIMENT

While this invention is susceptible of embodiment in many different forms, this specification and the accompanying drawings disclose only one specific form as an example of the invention. The invention is not intended to be limited to the embodiment so described, and the scope of the invention will be pointed out in the appended claims.

For ease of description, the sealer assembly of this invention is described in the normal (upright) operating position, and terms such as upper, lower, horizontal, etc., are used with reference to this position. It will be understood, however, that the sealer assembly of this invention may be manufactured, stored, transported, used, and sold in an orientation other than the position described.

Figure 1:
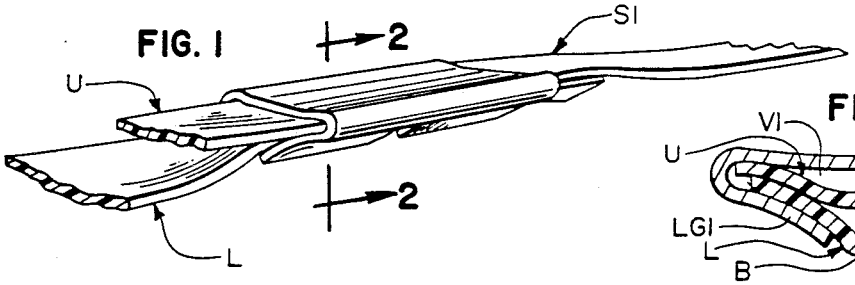
FIG. 1 is a fragmentary, perspective view of a conventional metal seal after it has been conventionally applied to overlapping lengths of thermoplastic strap.
Figure 2:
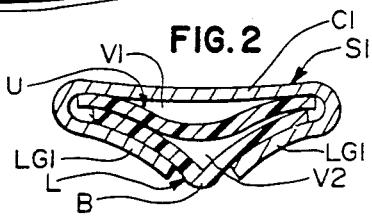
FIG. 2 is a greatly enlarged, cross-sectional view taken generally along the plane 2—2 in FIG. 1.
Figure 3:
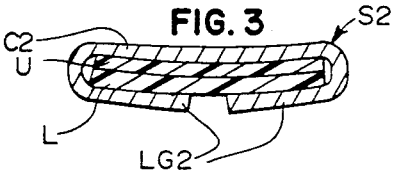
FIG. 3 is a view similar to FIG. 2 but showing a preferred seal configuration that is formed on thermoplastic strap according to the principles of the present invention.
Figure 4:
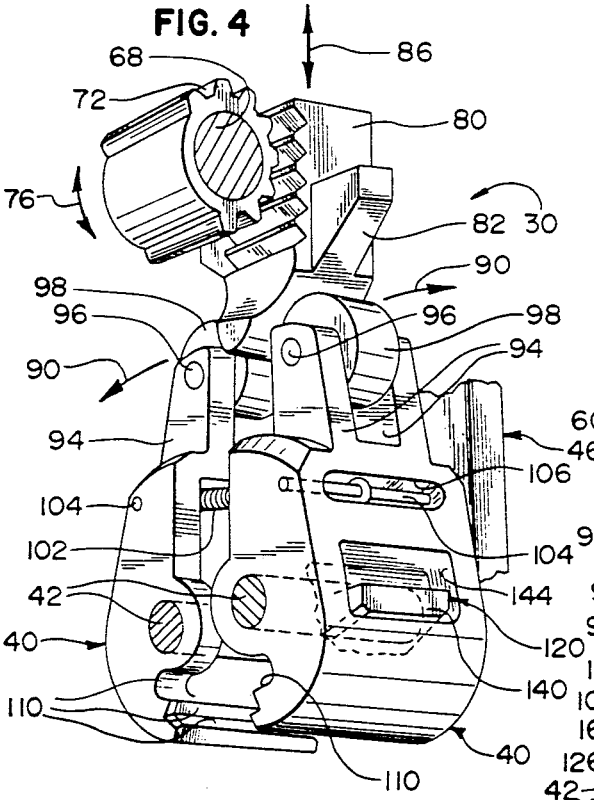
FIG. 4 is a fragmentary, perspective view of the sealer assembly of the present invention with portions of the assembly broken away to better illustrate interior detail and with portions of interior components omitted for clarity.

Referring to FIG. 4 of the drawings, the sealer mechanism of the present invention is generally designated therein by the reference numeral 30. The sealer mechanism 30 may be employed in a strapping tool or machine that can include a housing, strap end gripping mechanism, tensioning mechanism, seal magazine, and strap shearing mechanism. Such mechanisms may be of a special or a conventional design. Various types of conventional designs for such other mechanisms are employed in the Signode Corporation tools identified above and are disclosed in the above-identified operation manuals for such tools. Additional descriptions of such other mechanisms, as well of conventional sealer jaw mechanisms, are disclosed in a variety of patents. See, for example, U.S. Pat. Nos. 4,289,174, 4,015,643, 3,998,429 and 3,360,017. Descriptions in the above-identified documents of the various mechanisms, other than the sealer mechanism, are incorporated herein by reference to the extent pertinent and to the extent not inconsistent herewith. However, the detailed designs and specific structures of such other mechanisms form no part of the present invention.

The sealer assembly 30 is adapted to be mounted in a suitable housing (not illustrated) of a tool or machine and is adapted to be positioned for receiving, and acting upon, a fold-over type seal S2 and on an upper strap length U and lower strap length L which are positioned between the open legs LG2 of the seal S2 (FIGS. 3, 5–8, and 10–14).

Figure 7:
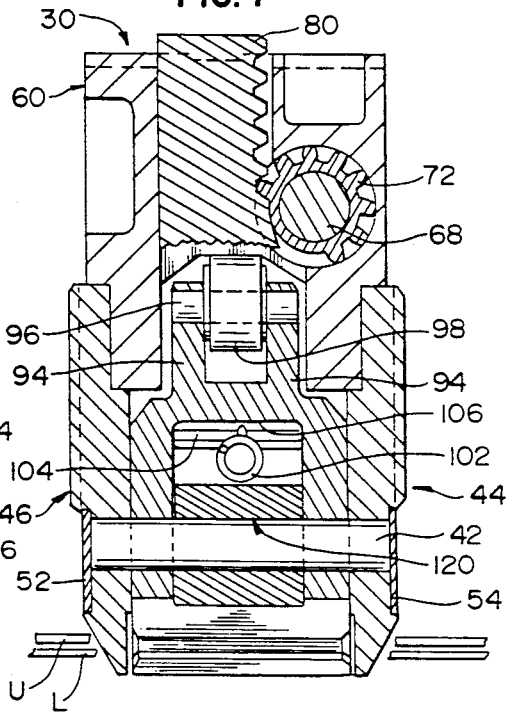
FIG. 7 is a cross-sectional view taken generally along the plane 7—7 in FIG. 5.
Figure 9:
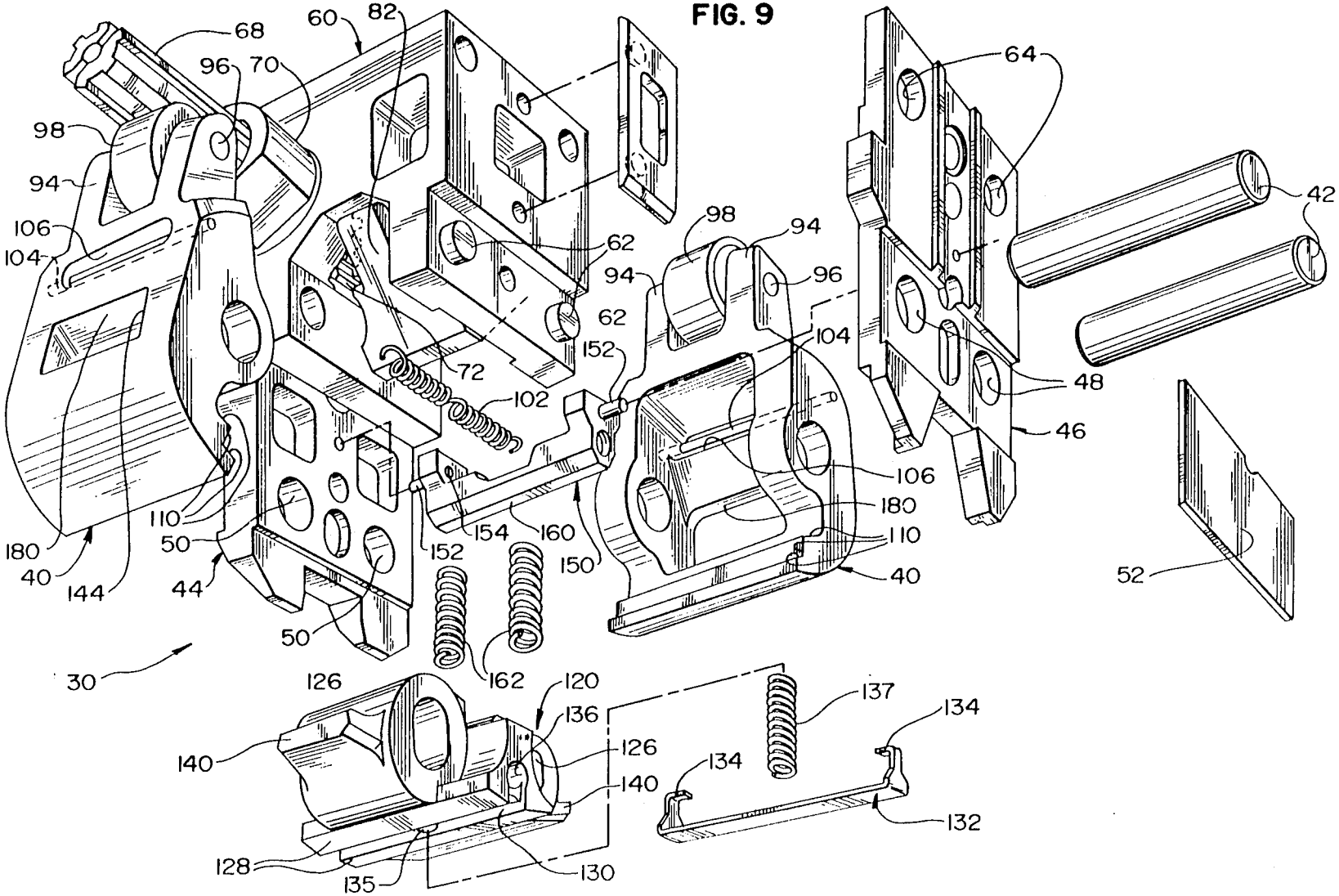
FIG. 9 is an exploded, perspective view of the sealer assembly.

The sealer mechanism 30 includes a pair of jaws 40 which are each pivotally mounted for swinging movement about a horizontal axis by means of a fixed pivot pin or shaft 42 which has its opposite ends mounted in front plate 44 and rear plate 46, respectively (FIGS. 7 and 9). With reference to FIG. 9, the shafts 42 are mounted in bores 48 in the rear plate 46 at one end and in bores 50 in the front plate 44 at the other end. A cover plate 52 is mounted over the ends of the shafts 42 in the rear plate 46, and a cover plate 54 (FIG. 7) is mounted over the ends of the shafts 42 in the front plate 44.

The front plate 44 and rear plate 46 extend upwardly along the jaws 40 and are adapted to engage suitable mating structures of the surrounding tool housing (not illustrated).

A jaw support block 60 is mounted between the front and rear plates 44 and 46, respectively, as best illustrated in FIGS. 5–9. To this end, each end of the support block 60 includes a pair of outwardly projecting posts 62 as illustrated for the visible rear end of the block 60 in FIG. 9. The posts 62 are received in bores 64 defined in the upper portion of the rear plate 46. A similar construction is employed to mount the other side of the support block 60 to the front plate 44.

The sealer block 60 supports a rotatable sealer mechanism actuator shaft 68 which is mounted in a bearing 70 on the jaw support block 60 (FIG. 9). As best illustrated in FIGS. 4–7, a pinion 72 is fixed to the shaft 68 for rotation therewith in either direction of rotation as indicated by the double-headed arrow 76 in FIG. 4. The pinion shaft 68 is operated by a suitable lever or handle (not illustrated).

The pinion 72 is engaged with a rack 80, the bottom end of which defines a cam 82 as best illustrated in FIG. 4. The rock 80 is driven upwardly or downwardly (as indicated by the double-headed arrow 86 in FIG. 4) by the rotation of the pinion 72. The cam 82, which defines upwardly angled camming surfaces, engages the jaws 40 to spread the upper portions of the jaws apart as illustrated by the arrows 90 in FIG. 4.

Figure 5:
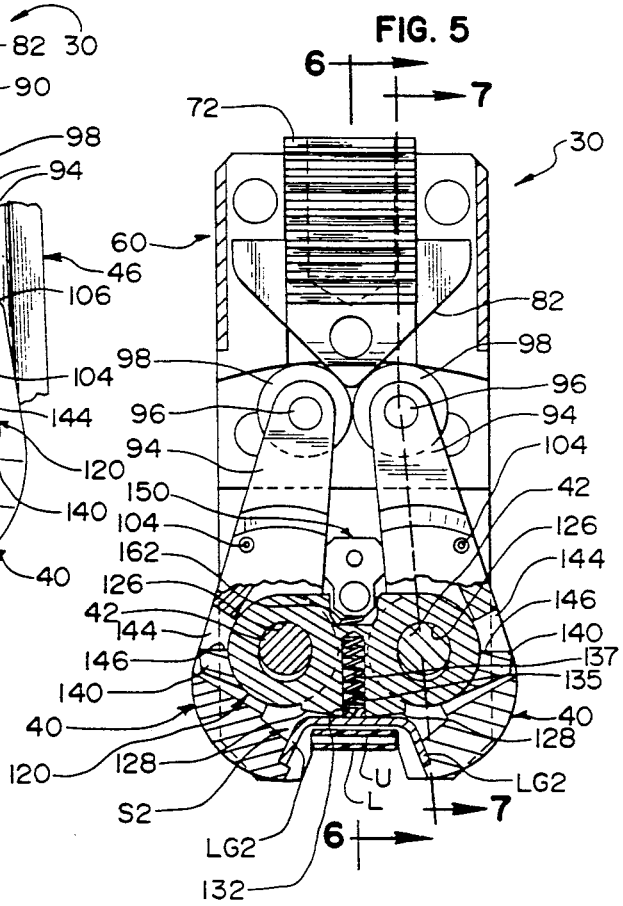
FIG. 5 is a front view of the assembly of FIG. 4 with portions of the assembly broken away to illustrate interior detail with portions of the assembly shown in cross section, and with the seal and overlapping strap lengths in an initial position in the assembly.

More particularly, the upper portion of each jaw 40 includes a pair of upwardly projecting, spaced-apart lugs 94 (FIG. 9). Each pair of lugs 94 receives a dowel pin 96 on which is mounted a roller 98. As best illustrated in FIGS. 4 and 5, the rollers 98 are adapted to be engaged by the cam 82 as the cam 82 is moved downwardly when the pinion shaft 68 is rotated in the appropriate direction. This causes the rollers 98 to be spread apart and effects a pivoting of the jaws 40 from the fully opened position (FIGS. 5, 8, and 10) to the fully closed position (FIG. 14).

Figure 8:
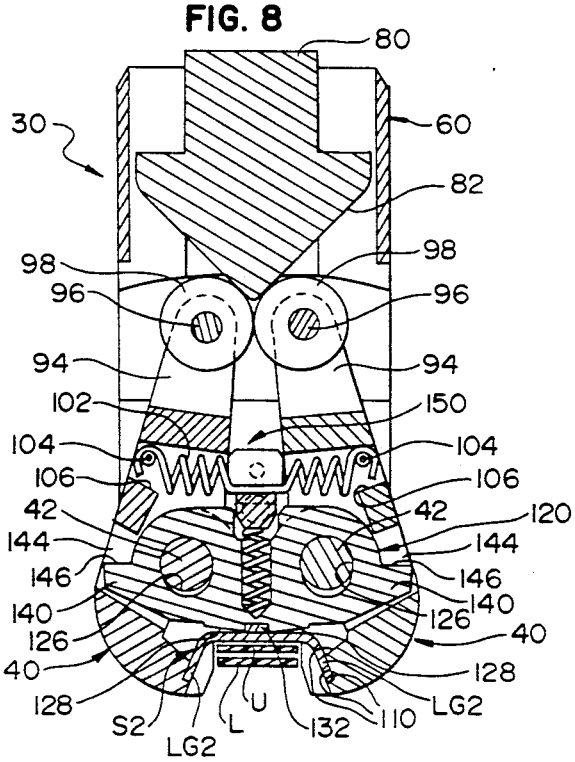
FIG. 8 is a cross-sectional view taken generally along the plane 8—8 in FIG. 6.

The jaws 40 are normally biased to the fully opened position by means of a helical, tension spring 102 (FIGS. 4, 8, and 9). Each end of the spring 102 has a hook-like configuration for engaging a pin 104 carried in one of the jaws 40. The central portion of each pin 104, along with the end of the spring 102 engaged therewith, is accommodated within a cavity 106 defined by the jaw 40 as best illustrated in FIGS. 4 and 6–9.

In operation, the pinion shaft 68 is rotated with sufficient torque to overcome the biasing effect of the spring 102. However, when the direction of rotation of the shaft 68 is reversed to raise the cam 82, the spring 102 causes the jaws 40 to pivot to the open position (FIGS. 5–8 and 10).

Figure 11:
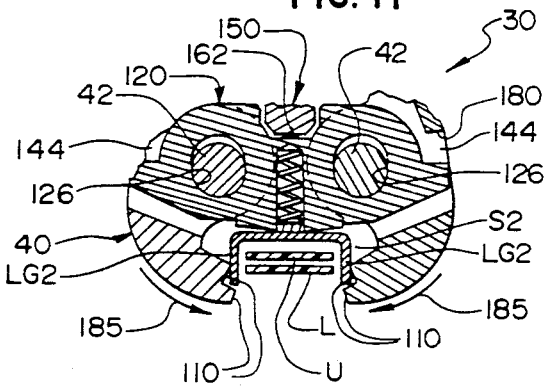
Figure 12:
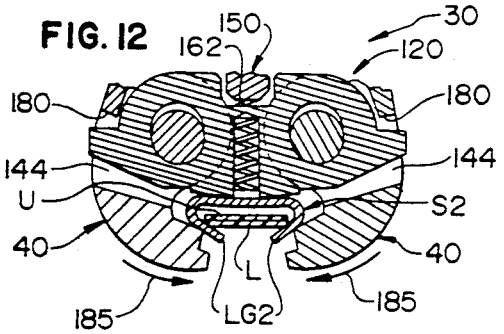
Figure 13:
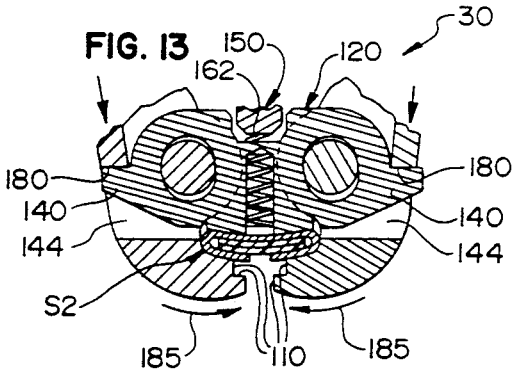
Figure 14:
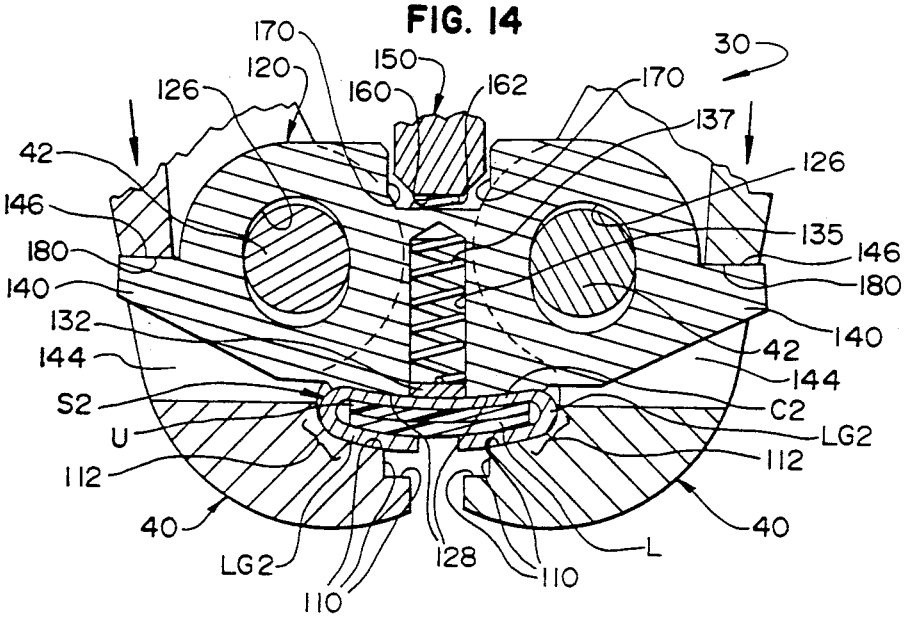
FIG. 14 is a greatly enlarged view similar to FIG. 13 showing the fully crimped configuration of the seal and overlapping strap lengths.

The lower end of each jaw 40 defines a seal engaging surface 110 as best illustrated in FIGS. 4, 8 and 14. The surface 110 is preferably "stepped" to initially hold the open seal legs LG2 as illustrated in FIG. 5 and to subsequently act upon, and deform the seal legs as the jaws pivot closed as illustrated in FIGS. 11–13. As best illustrated in FIG. 14, the seal engaging surface 110 preferably also includes an arcuate region 112 for accommodating the bend of the seal leg LG2 adjacent the region where the leg LG2 merges with the seal crown C2.

To aid in crimping the seal S2, the sealer assembly 30 includes a unique anvil or "chair" 120 against which the seal S2 seats during the crimping operation (as best illustrated in FIGS. 5, 6, 8, 9, and 14). The chair or anvil 120 defines a pair of elongate apertures 126, and each aperture 126 receives one of the jaw pivot shafts 42 to permit relative movement between the shaft and the aperture in a direction perpendicular to the length of the shaft (toward and away from the strap lengths U and L).

The anvil 120 defines a downwardly projecting, downwardly facing strap-engaging surface 128. As best illustrated in FIGS. 5, 8, and 14, the seal-engaging surface 128 engages the upwardly facing exterior surface of the crown of the seal S2.

The surface 128 is divided in half by a central channel 130 (FIG. 9) which receives a retaining clip 132. Each end of the retaining clip 132 includes an inwardly bent tab 134. Each tab 134 is received in a bore 136 defined in an end of the anvil 120. The bores 136 are sufficiently large to accommodate a slight vertical movement of the tabs 134 so that the clip 132 can move upwardly and downwardly relative to the channel 130 and relative to the anvil seal-engaging surfaces 128.

In addition, the anvil defines a downwardly open bore 135 in which is received a helical compression spring 137 for normally biasing the retaining clip 132 downwardly somewhat below the anvil seal engaging surface 128.

The distance between the bottom surface of the retaining clip 132 and its tabs 134 is greater than the distance between the bottoms of the receiving bores 136 and the seal engaging surfaces 128 so that the clip 132 is normally pushed outwardly (downwardly) by the spring 137 below the seal-engaging surfaces 128. This aids in receiving and retaining a seal S2 when the jaws 40 are in the fully opened position.

In particular, as the seal S2 is slid into the open jaws 40 (by suitable conventional means which are not illustrated and which form no part of the present invention), the seal S2 engages the downwardly biased clip 132. The bottom edges of the seal legs LG2 thus slide along the seal-engaging surfaces of the jaws 40. This mechanism thus accommodates slight variations in seal height and serves to retain the seal by spring action within the open jaws 40.

In FIGS. 5, 6, 8, and 10, the fully open jaws 40 are shown receiving a seal S2 that has the maximum height that could be accommodated, and the retaining clip 132 is necessarily fully recessed in the channel 130. However, with a seal S2 having slightly shorter legs LG2, the clip 132 would be biased downwardly somewhat by the spring 137 as the seal S2 is forced into the seal-engaging surfaces of the open jaws 40. Then, as the jaws 40 begin to close, the seal would be forced upwardly against the retaining clip 132 which would be forced up into the channel 130.

The anvil 120 also has a pair of oppositely projecting tabs 140 as best illustrated in FIGS. 5, 8, 9, 10, and 14. Each tab 140 extends through an aperture 144 (FIGS. 4, 9, and 14) defined in the adjacent jaw 40. Each tab 140 defines an upwardly facing surface 146 for being engaged by the edge of the jaw 40 around the aperture 144 in novel manner that is described in detail hereinafter.

Figure 6:
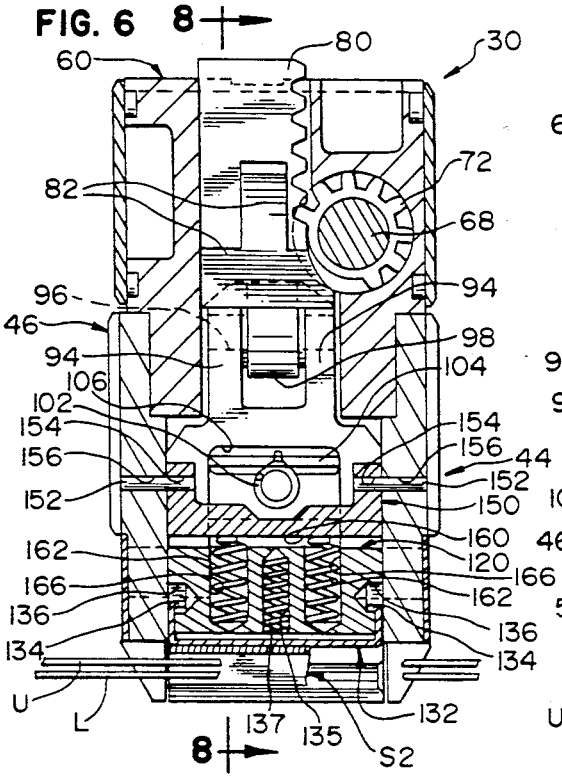
FIG. 6 is a cross-sectional view taken generally along the plane 6—6 in FIG. 5.

The anvil 120 is normally biased downwardly within the assembly toward the strap lengths U and L when the jaws 40 are in the open position (e.g., FIGS. 5, 6, and 8). To this end, a spacer member or reaction member 150 is mounted to, and extends between, the front plate 44 and rear plate 46. The reaction member 150 is mounted at each end with pins 152 projecting from bores 154 on each end of the member 150 as best illustrated in FIGS. 6 and 9. Each plate 44 and 46 defines a corresponding bore 156 for receiving the projecting portion of one of the pins 152. This arrangement fixes the reaction member 150 within the assembly.

The reaction member 150 defines a downwardly facing bearing surface 160 against which helical compression springs 162 bear. Each spring 162 is received within an upwardly open bore 166 (FIG. 6) defined in the anvil 120. The springs 162 act to normally urge the anvil 120 downwardly relative to the jaw pivot pins 42 so that, at the lowermost position, the top of each anvil elongate aperture 144 engages the top surface of the pin 42 received therein as illustrated in FIGS. 5, 7, and 8. The movement of the anvil 120 relative to the fixed reaction member 150 may be guided, to the extent that the clearances between the pins 42 and the apertures 126 permit, by vertical walls 170 which are defined on the top of the anvil 120 on either side of the reaction member 160 as best illustrated in FIGS. 5, 8, 9, and 14.

Although the anvil is normally biased to the downward position as illustrated in FIG. 8 when the jaws 40 are open. However, the anvil 120 is permitted to move upwardly during the closing of the jaws 40 to the maximum elevation permitted at the point where the bottoms of the anvil elongate apertures 126 engage the pivot pins 42 as best illustrated in FIG. 11. This arrangement may be characterized as a "first lost motion means" for mounting the anvil 120 for reciprocative movement relative to the jaw axes in directions toward and away from the strap lengths and for limiting the movement of the anvil 120 relative to the jaw pivot axes at least in the direction away from the strap lengths. This first lost motion arrangement may also be characterized as one which permits movement of the seal-engaging surface of the anvil toward the jaw pivot axes and which limits the movement of the anvil seal-engaging surface relative to the jaw pivot axes at least in the direction toward the jaw pivot axes.

The arrangement wherein the anvil tabs 140 project into the apertures 144 of the jaws 40 may be characterized as a "second lost motion means" in that relative movement between the anvil 120 and jaws 40 is permitted until the jaws have pivoted toward the closed position some amount. Then the jaws 40 engage the anvil tabs 140 with a downwardly facing driving surface 180 defined at the top of each jaw aperture 144. This results in the jaws 40 driving the anvil 120 back downwardly relative to the jaw pivot pins 42 during the crimping operation which is next explained in detail.

The crimping operation is illustrated in sequential steps in FIGS. 10–13. FIG. 14 is a greatly enlarged view similar to FIG. 13 and shows the jaws in the closed position with the seal S2 fully crimped.

Figure 10:
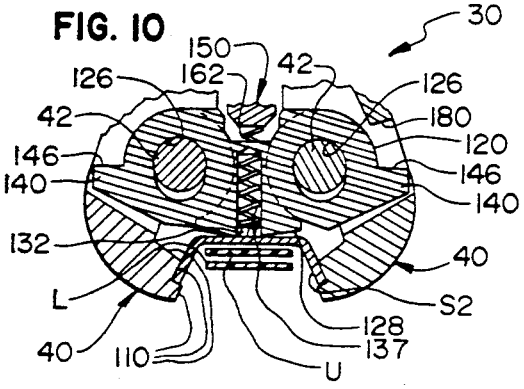
FIGS. 10–13 are fragmentary, cross-sectional views similar to FIG. 5 and illustrate the sequence of operation of the sealer assembly.

Initially, the upper strap length U and lower strap length L are positioned in the jaw assembly 30 as illustrated in FIG. 10. A seal S2 is fed into the jaw assembly (by any suitable special or conventional means which form no part of the present invention). The seal S2 is held within the open jaws 40 by the retaining clip 132. The clip 132 is biased against the top of the seal S2 by the spring 137, and the seal S2 is held tightly between the clip 132 and the jaws 40.

In the initial, open position with the seal S2 loaded as illustrated in FIG. 10, the anvil 120 is also biased to its downward most position relative to the pins 42 by means of the springs 162 which are in compression between the anvil 120 and the fixed reaction member 150.

Next, the assembly 30 is operated to pivot the jaws 40 toward the closed position as indicated by the arrows 185 in FIG. 11. This causes the jaw seal-engaging surfaces 110 to bend the seal legs LG2 inwardly and causes an upwardly directed force to be applied to the seal S2 so as to drive the seal upwardly against the anvil 120 to overcome the downward biasing force of the springs 162.

As the seal 52 moves upwardly away from the overlapping strap lengths U and L, the orientation of the forces applied to the seal legs LG2 by the jaws 40 changes. The bending region of the seal legs LG2 (where the legs merge with the seal crown) necessarily moves upwardly with the seal. Thus, the leg bending region moves upwardly relative to the jaw pivot axes defined by the pivot pins 42 and relative to the strap lengths U and L. This affects the bending or folding radius of the seal legs compared to prior art sealer mechanism designs wherein the seal would be maintained at or below the initial position relative to the jaw pivot axes.

The upward movement of the seal S2 (during the action of the jaws 40 to bend the legs inwardly) permits the legs to bend in a more desirable manner. That is, the lateral edges of the strap lengths U and L are not initially wedged in the bend region under excessive forces, and the strap edges do not act as a bending or forming mandrel. When thermoplastic strap is used with a conventional sealer assembly, the initial bending radius of the seal legs is not raised relative to the jaw pivot axes, and the bending occurs directly about the strap edges. This is believed to result in the poor quality crimped seal joints discussed above in the section entitled "BACKGROUND OF THE INVENTION AND TECHNICAL PROBLEMS POSED BY THE PRIOR ART".

With continued reference to FIG. 11, it is seen that the bottoms of the elongate apertures 126 of the anvil 120 eventually engage the pivot pins 42 and limit further upward movement of the anvil (and hence, of the seal S2). In the preferred form of the invention illustrated, the upward movement of the anvil 120 is terminated after the seal legs LG2 have been bent inwardly to a substantially vertical orientation (as shown in FIG. 11). This arrangement wherein the anvil 120 can move upwardly relative to the jaw pivot axes is the previously described "first lost motion means".

In the preferred embodiment illustrated, when the anvil 120 is in its uppermost position (FIGS. 11 and 12), there is still a small clearance between the bottom of the reaction member 150 and the anvil 120. This ensures that the upward movement of the anvil 120 will be limited by the engagement of the anvil 120 with the pivot pins 42 rather than with the reaction member 150.

With reference to FIG. 12, it will be appreciated that as the jaws 40 continue to be pivoted toward the closed position, the jaws force the seal legs LG2 further inwardly and upwardly against the seal crown which is now stationary. Because the anvil 120 and seal S2 are still elevated, the legs LG2 continue to bend inwardly about the bend region with a desired bend radius that does not apply undue lateral forces to the edges of the strap lengths U and L.

As the jaws 40 continue to be pivoted to the closed position, the driving surfaces 180 at the top of the jaw apertures 144 are necessarily pivoted downwardly with the upper portions of the jaws until the driving surfaces 180 engage the anvil tabs 140 as illustrated in FIG. 13. The driving surfaces 180 then force the anvil 120 downwardly toward the seal-engaging surfaces 110 of the jaws 40. This drives the crown-engaging surface 128 of the anvil with great force against the crown of the seal S2. The seal, and the strap lengths within the seal, are compressed tightly together as the fully crimped joint is formed as illustrated in FIG. 14.

It will be appreciated that as the anvil 120 is driven downwardly by the driving surfaces 180 on the sides of the jaws 40, relative movement is effected between the anvil 120 and the jaw pivot pins 42 so that the bottoms of the anvil apertures 126 move downwardly away from the pins 42 and the clearance above the pins 42 within the apertures 126 decreases. Preferably, the apertures 126 are sufficiently elongate so that the tops of the apertures 126 do not "bottom out" or engage the tops of the pins 42 when the jaws are in the fully crimped orientation as shown in FIG. 14. It is, of course, desirable to apply a sufficiently large crimping force with the coacting anvil 120 and jaws 40 and not have the downward movement of the anvil 120 limited by engagement between the apertures 126 and the pins 42 when the seal is fully crimped.

After the seal S2 has been fully crimped as illustrated in FIG. 14, the jaws 40 are pivoted back to the fully opened position as illustrated in FIG. 10, and the straps, now crimped together with the seal S2, are disengaged from the sealing assembly 30.

It will be appreciated that the arrangement between the anvil tabs 140 and the driving surfaces 180 of the jaws 40 define the previously described "second lost motion means". This accommodates movement of the anvil seal-engaging surface 128 toward the jaw pivot axes and effects engagement between the driving surfaces 180 and the anvil tabs 140 at an end of the range of the lost motion as the jaws 40 pivot toward the closed position. This second lost motion means accommodates, and does not interfere with, the operation of the "first lost motion means" defined by the anvil elongate apertures 126 and the pivot pins 42 during an initial portion of the total angular displacement of the jaw motion. However, the second lost motion means (i.e., the driving surfaces 180 and tabs 140) consequently functions to effect a reverse movement of the anvil 120 relative to the jaw pivot pins 42 through the remainder or final portion of the total angular displacement of the jaws.

The novel sealing assembly of this invention can accommodate a variety of strap materials and sizes as well as a variety of seal materials and sizes. The assembly is particularly versatile and can be readily modified or adjusted to control the desired seal leg bending radius, forces, etc. For example, the final crimping action can be adjusted by adding shims between the anvil tabs 140 and the jaw driving surfaces 180. Adjusting screws could be provided in the place of such shims.

It will be readily observed from the foregoing detail description of the invention and from the illustrated embodiment thereof that numerous other variations and modifications may be effected without departing from the true spirit and scope of the novel concepts or principles of this invention.

What is claimed is:

1. A method for applying a fold-over seal about overlapping lengths of strap wherein said seal is initially furnished in an open condition with a pair of open legs joined by a central crown, said method comprising the steps of:

(A) positioning said open seal with the crown disposed between an anvil surface and said strap lengths and with the strap lengths located between the seal legs;

(B) pivoting a pair of jaws about pivot axes against said open seal legs toward said strap lengths to force said seal legs to bend inwardly and urge said seal crown and anvil surface away from said strap lengths to change the orientation of the force applied to each seal leg;

(C) limiting the movement of said anvil surface away from said strap lengths in step (B) while said seal crown is against said anvil surface and continuing to further pivot said jaws to fold over said seal legs adjacent said strap lengths; and (D) after step (C), moving said anvil surface to urge said seal crown back toward said strap lengths to force said seal crown and legs closer together and thereby complete the crimping of said seal about said strap lengths.

2. A method for applying a fold-over seal about overlapping lengths of strap wherein said seal is initially furnished in an open condition with a pair of open legs joined by a central crown, said method comprising the steps of:

(A) positioning said open seal with the crown disposed between an anvil surface and said strap lengths and with the strap lengths located between the seal legs;

(B) pivoting a pair of jaws about pivot axes against said open seal legs toward said strap lengths to bend said seal legs inwardly and urge said seal and anvil toward said jaw pivot axes;

(C) limiting the movement of said anvil surface toward said jaw pivot axes and continuing to further pivot said jaws to fold over said seal legs adjacent said strap lengths; and (D) after step (C), moving said anvil surface to urge said seal crown away from said jaw pivot axes and force said seal crown and legs closer together to thereby complete the crimping of said seal about said strap lengths.

3. A method for applying a fold-over seal about overlapping lengths of strap wherein said seal is initially furnished in an open condition with a pair of open legs joined by a central crown, said method comprising the steps of:

(A) positioning said open seal with said strap lengths between said seal legs;

(B) pivoting a pair of jaws about pivot axes against said open seal legs toward said strap lengths to bend said seal legs inwardly while decreasing the distance between said seal and the pivot axes of said jaws;

(C) limiting the movement of said seal toward said jaw pivot axes and continuing to further pivot said jaws to fold over said seal legs adjacent said strap lengths; and (D) after step (C), increasing the distance between said seal and said jaw pivot axes to force said seal crown and legs closer together and thereby complete the crimping of said seal about said strap lengths.

4. The method in accordance with claim 1 in which step (D) includes continuing to pivot said jaws to further bend said seal legs inwardly.

5. The method in accordance with claim 2 in which step (D) includes continuing to pivot said jaws to further bend said seal legs inwardly.

6. The method in accordance with claim 3 in which step (D) includes continuing to pivot said jaws to further bend said seal legs inwardly.

7. The method in accordance with claim 1 in which steps (B) through (D) are effected to cause said jaws to be pivoted through a total angular displacement between fully opened and fully closed positions: and said anvil surface is defined by an anvil and step (D) includes (1) engaging said anvil with parts of said jaws after said jaws have each been pivoted through an initial portion of the total angular displacement and (2) continuing to pivot said jaws through the remainder of the total angular displacement to the fully closed position while the jaws are engaged with said anvil parts to force said anvil surface back toward said strap lengths.

8. The method in accordance with claim 2 in which steps (B) through (D) are effected to cause said jaws to be pivoted through a total angular displacement between fully opened and fully closed positions; and said anvil surface is defined by an anvil and step (D) includes (1) engaging said anvil with parts of said jaws after said jaws have each been pivoted through an initial portion of the total angular displacement and (2) continuing to pivot said jaws through the remainder of the total angular displacement to the fully closed position while the jaws are engaged with said anvil parts to force said anvil surface back toward said strap lengths.

9. The method in accordance with claim 1 in which said method includes providing each said jaw on a pivot shaft for accommodating a total angular displacement between a fully closed position and a fully opened position and providing each said jaw with a first portion of the jaw extending from said pivot shaft to define a seal engaging surface and with a second portion of the jaw extending from said pivot shaft in a direction generally opposite from said first portion to define a driving surface;

said method includes providing an anvil defining said anvil surface and defining two oppositely extending tabs each adjacent one of said jaw driving surfaces; and step (D) includes (1) pivoting said jaws to engage said anvil tabs with said jaw driving surfaces after said jaws have each been pivoted from the fully opened position through the initial portion of the total angular displacement and (2) continuing to pivot said jaws through the remainder of the total angular displacement while the jaw driving surfaces are engaged with said anvil tabs to move said anvil surface back toward said strap lengths.

10. The method in accordance with claim 2 in which said method includes providing each said jaw on a pivot shaft for accommodating a total angular displacement between a fully closed position and a fully opened position and providing each said jaw with a first portion of the jaw extending from said pivot shaft to define a seal engaging surface and with a second portion of the jaw extending from said pivot shaft in a direction generally opposite from said first portion to define a driving surface;

said method includes providing an anvil defining said anvil surface and defining two oppositely extending tabs each adjacent one of said jaw driving surfaces; and step (D) includes (1) pivoting said jaws to engage said anvil tabs with said jaw driving surfaces after said jaws have each been pivoted from the fully opened position through the initial portion of the total angular displacement and (2) continuing to pivot said jaws through the remainder of the total angular displacement while the jaw driving surfaces are engaged with said anvil tabs to move said anvil surface back toward said strap lengths.

11. The method in accordance with claim 1 further including the step of biasing said anvil surface against said seal crown during at least step (B).

12. The method in accordance with claim 2 further including the step of biasing said anvil surface against said seal crown during at least step (B).

13. The method in accordance with claim 2 in which each said seal leg is joined along a bend region to said crown and in which step (B) includes the step of continuously applying a crimping force with each said jaw to one of said seal legs at locations beyond a predetermined minimum distance from said seal bend region as the distance between said seal and said jaw pivot axes is decreased prior to effecting step (C).

14. The method in accordance with claim 3 in which each said seal leg is joined along a bend region to said crown and in which step (B) includes the step of continuously applying a crimping force with each said jaw to one of said seal legs at locations beyond a predetermined minimum distance from said seal bend region as the distance between said seal and said jaw pivot axes is decreased prior to effecting step (C).

15. A sealing assembly for crimping the legs of a fold-over type seal toward the crown of the seal and about overlapping lengths of strap, said assembly comprising:

a pair of opposing sealer jaws for each engaging one of said seal legs;

mounting means for mounting each said jaw for pivoting movement about a pivot axis between (1) an open position for receiving said strap lengths with an uncrimped seal disposed therein adjacent said strap lengths and (2) a closed position in which said seal is crimped about said strap lengths;

an anvil having a seal-engaging surface for engaging the seal crown and first lost motion means for mounting said anvil for reciprocative movement relative to said jaw pivot axes and for limiting the movement of said anvil relative to said jaw pivot axes at least in the direction away from said strap lengths; and second lost motion means for accommodating movement of said anvil seal-engaging surface toward said jaw pivot axes and for effecting engagement between a portion of each said jaw and said anvil at an end of the range of the second lost motion means as said jaws pivot toward said closed position whereby said anvil is driven by said jaws to move said seal-engaging surface of said anvil back away from said jaw pivot axes toward said strap lengths.

16. The sealing assembly in accordance with claim 15 in which said assembly includes at least one side plate; and said mounting means includes two pivot shafts defining said pivot axes, each said shaft being mounted in said side plate, each said jaw being mounted on one of said pivot shafts.

17. The sealing assembly in accordance with claim 15 in which said assembly includes at least one mounting plate;

said assembly includes a reaction member mounted to, and extending from, said mounting plate; and said assembly includes biasing means between said reaction member and said anvil for urging said anvil away from said reaction member to increase the distance between said seal-engaging surface and said jaw pivot axes.

18. The sealing assembly in accordance with claim 15 in which said anvil has a seal-engaging surface projecting downwardly and said anvil has oppositely projecting tabs spaced from said engaging surface;

said jaws are mounted to accommodate a total angular displacement between said closed and open positions, said jaws each defining a driving surface for engaging one of said tabs; and said anvil and jaws being arranged to prevent engagement between said anvil tabs and driving surfaces when the jaws are in the open position but to effect engagement between said anvil tabs and said driving surfaces after said jaws have been pivoted from said open position through an initial portion of the total angular displacement, said arrangement of said anvil tabs and jaw driving surfaces defining said second lost motion means.

19. The sealing assembly in accordance with claim 15 in which said mounting means includes two, parallel, pivot shafts defining said pivot axes, one of said jaws being mounted on one of said shafts and the other of said jaws being mounted on the other of said shafts; and said anvil defines elongate apertures, each aperture receiving one of said shafts to permit relative movement between said one shaft and an elongate aperture in a direction perpendicular to the length of the shaft, said arrangement of said shafts and apertures defining said first lost motion means.

20. A sealing assembly for crimping the legs of a fold-over type seal toward the crown of the seal and about overlapping lengths of strap, said assembly comprising:

a pair of opposing sealer jaws for each engaging one of said seal legs;

mounting means for mounting each said jaw for pivoting movement about a pivot axis between (1) an open position for receiving said strap lengths with an uncrimped seal disposed therein adjacent said strap lengths and (2) a closed position in which said seal is crimped about said strap lengths;

an anvil for engaging the seal crown and first lost motion means for mounting said anvil for reciprocative movement relative to said jaw pivot axes in directions toward and away from the strap lengths and for limiting the movement of said anvil relative to said jaw pivot axes at least in the direction away from said strap lengths; and second lost motion means for accommodating movement of said anvil away from said strap lengths and for effecting engagement between a portion of each said jaw and said anvil at an end of the range of the second lost motion means as said jaws pivot toward said closed position whereby said anvil is driven by said jaws back toward said strap lengths.

21. A sealing assembly for crimping the legs of a fold-over type seal toward the crown of the seal and about overlapping lengths of strap, said assembly comprising:

a pair of opposing sealer jaws for each engaging one of said seal legs;

a pair of jaw pivot shafts each defining a pivot axis and mounted at a fixed elevation, one of said jaws being pivotally mounted on one of said pivot shafts and the other of said jaws being pivotally mounted on the other of said pivot shafts, said jaws being pivotable through a total angular displacement between (1) an open position for receiving said strap lengths with an uncrimped seal disposed therein adjacent said strap lengths and (2) a closed position in which said seal is crimped about said strap lengths;

opening means for biasing said jaws to pivot from said closed position to said open position;

actuator means for being operated to overcome the biasing effect of said opening means to pivot said jaws to said closed position;

an anvil having a seal-engaging surface for engaging the seal crown and having at least one projecting tab, said anvil defining elongate apertures for receiving said jaw pivot shafts to mount said anvil thereon for reciprocative movement relative to said jaw pivot shafts in directions toward and away from the strap lengths and for limiting the movement of said anvil relative to said jaw pivot shafts at least in the direction away from said strap lengths;

biasing means for biasing said anvil toward said strap lengths and against said seal crown; and said jaws each defining a driving surface for engaging one of said anvil tabs after said jaws have been pivoted from said open position through an initial portion of the total angular displacement whereby said anvil is driven by said jaws back toward said strap lengths as the crimping of said seal is completed.

* * * * *